US007409955B2

(12) United States Patent
Mauldin et al.

(10) Patent No.: US 7,409,955 B2
(45) Date of Patent: Aug. 12, 2008

(54) CIGARETTE PRESERVER-CONTAINER

(75) Inventors: Beau Austin Mauldin, Longmont, CO (US); Richard Garret Mauldiin, Erie, CO (US)

(73) Assignee: Origin-8, LLC, Erie, CO (US)

( * ) Notice: Subject to any disclaimer, the term of this patent is extended or adjusted under 35 U.S.C. 154(b) by 463 days.

(21) Appl. No.: 10/932,778

(22) Filed: Sep. 2, 2004

(65) Prior Publication Data

US 2005/0045195 A1 Mar. 3, 2005

(51) Int. Cl.
*A24F 13/24* (2006.01)
*A24F 15/00* (2006.01)

(52) U.S. Cl. ..... 131/250; 131/233; 131/253; 131/248; 131/252; 206/238; 206/265; 206/276

(58) Field of Classification Search ..... 131/233, 131/250
See application file for complete search history.

(56) References Cited

U.S. PATENT DOCUMENTS

| | | | | |
|---|---|---|---|---|
| 2,021,273 | A * | 11/1935 | Vallinos | 206/261 |
| 2,120,027 | A | 6/1938 | Johnson | 131/51 |
| 2,371,445 | A | 3/1945 | Irvin | 131/256 |
| 2,715,961 | A | 8/1955 | Field | 206/38 |
| 3,978,981 | A | 9/1976 | Musick | 206/276 |
| 4,587,981 | A | 5/1986 | Boden et al. | 131/278 |
| 4,809,715 | A | 3/1989 | Musetti | 131/256 |
| 5,002,073 | A | 3/1991 | Chiang | 131/178 |
| 5,345,952 | A | 9/1994 | Nielander | 131/248 |
| 5,345,953 | A | 9/1994 | Taylor | 131/256 |
| 5,749,461 | A * | 5/1998 | Guzman | 206/245 |
| 5,752,527 | A | 5/1998 | Bowen et al. | 131/175 |
| 5,947,280 | A | 9/1999 | Jimenez | |
| 6,431,177 | B1 | 8/2002 | Sieggen et al. | 131/256 |
| 6,446,793 | B1 * | 9/2002 | Layshock | 206/86 |
| 2003/0172943 | A1 | 9/2003 | Connolly | |

* cited by examiner

*Primary Examiner*—Philip C Tucker
*Assistant Examiner*—Phu H Nguyen
(74) *Attorney, Agent, or Firm*—Cook, Alex, McFarron, Manzo, Cummings & Mehler, Ltd.; Edward D. Manzo

(57) ABSTRACT

A combined cigarette cutter and container includes a cigarette cutter illustratively engaged to an upper inside surface of a lid of a container which holds preferably a single cigarette (or cigar). The user may partially smoke it, cut off the used portion using the cutter, insert the unused portion in the container, and close the lid. This provides a convenient carrying mechanism to permit later consumption of the cigarette or cigar. In other embodiments, the case has curved major surfaces with a fixedly-fastened cutter adjacent to one of the end walls. The cutter can be omitted to provide a case.

19 Claims, 8 Drawing Sheets

CIGARETTE PRESERVER-CONTAINER

BACKGROUND OF THE INVENTION

The present invention concerns a portable cigarette cutter and container. A number of cigarette or cigar containers are known in the art. For example, Nielander U.S. Pat. No. 5,345,952 is directed to a portable cigarette cutter, extinguisher and conveyance apparatus. A cigarette is inserted into an aperture located co-axially in a comparatively large, round cylindrical container having a lower reservoir 14 and upper enclosure and receiver assembly 16. The Nielander container is shown much larger than the size of a cigarette. Next, the user pushes a member 18 which moves a blade traversely through the cigarette to slice off part of it. The sliced-off part of the cigarette is moved into the reservoir and deprived of air, causing it to extinguish. Nielander specifically asserts that this device has a "convenient size to be readily portable" and that it is a "conveyance apparatus" (among other things). However, it appears that Nielander does not contemplate transporting the cigarette in the disclosed apparatus, but instead the consumed portions (ashes). Thus, Nielander states, "The cigarette smoker using the invention will retain the cigarette 12 without the severed portion 158 as noted in FIG. 8 and store it in a cigarette pack for further usage." Col. 8 lines 21-24.Accordingly, Nielander does not provide a combination cigarette cutter and transport case for the unused portion of the severed cigarette. Moreover, the container of the device disclosed in Nielander is many times larger than a single cigarette and is not suitable for carrying in a shirt or pants pocket, for example.

Numerous other patents are directed to a cigarette or cigar extinguisher or storage device. Sieggen et al. U.S. Pat. No. 6,431,177 discloses a device that is roughly shaped like a fountain pen for extinguishing and storing a cigarette. Taylor U.S. Pat. No. 5,345,953 is another cylindrical-shaped cigarette snuffer. Musick U.S. Pat. No. 3,978,981 discloses a cylindrical device for a lighted cigar holder, which is also applicable to cigarettes. This permits the user to carry a lighted cigar or cigarette on his person. Musetti U.S. Pat. No. 4,890,715 is for a "pocket ashtray" in which a cigarette or cigar is extinguished. This too is a cylindrical shape, pen-size device. See also Irvin U.S. Pat. No. 2,371,445; Field U.S. Pat. No. 2,715,961; and Johnson U.S. Pat. No. 2,120,027. Another prior art apparatus combines a writing tool with a cigarette extinguisher. See Chiang U.S. Pat. No. 5,002,073.

None of these prior art disclosures, however, discloses a device according to the features of the present invention, which allows for the clipping or severing the used part of a cigarette and the insertion of the remaining unused portion into a compact carrying case for storage and subsequent use.

SUMMARY OF THE INVENTION

According to various features of the present invention, a compact size device is provided for containing preferably one cigarette (or cigar). Preferably the device includes two portions joined together for relative movement. Preferably the two portions are longitudinally oriented members joined by a longitudinal hinge, and preferably the two members join to form an enclosure or compartment. Associated with the device is a cutter for separating a burning portion of the cigar-cigarette from the unused portion. Preferably the cutter is affixed to an interior portion of the device, and in one embodiment the cutter may be engaged releasably by the device or may rotate from a stored position into an operational position. In other embodiments, the cutter may not be releasable or rotatable. Illustratively, the cutter may comprise a single blade or a scissor-type device. In described alternate embodiments, the blade is fastened adjacent to an end wall and configured to move along with the member to which it is attached, illustratively the upper or the lower portion. The user places the cigar-cigarette in position and closes the device, thus causing the blade to sever the burning end of the cigar-cigarette, in these alternate embodiments. When a scissor-type cutter is used, the blades are located in the opposing upper and lower members. Preferably the compartment is air tight, so that any portion that is still burning or smoldering will consume the available oxygen in the compartment and then extinguish.

BRIEF DESCRIPTION OF THE DRAWINGS

In describing preferred embodiments of the present invention, reference is made to the accompanying drawings wherein like reference like numerals represent like parts and wherein.

DETAILED DESCRIPTION OF PREFERRED EMBODIMENTS

Figure 1:
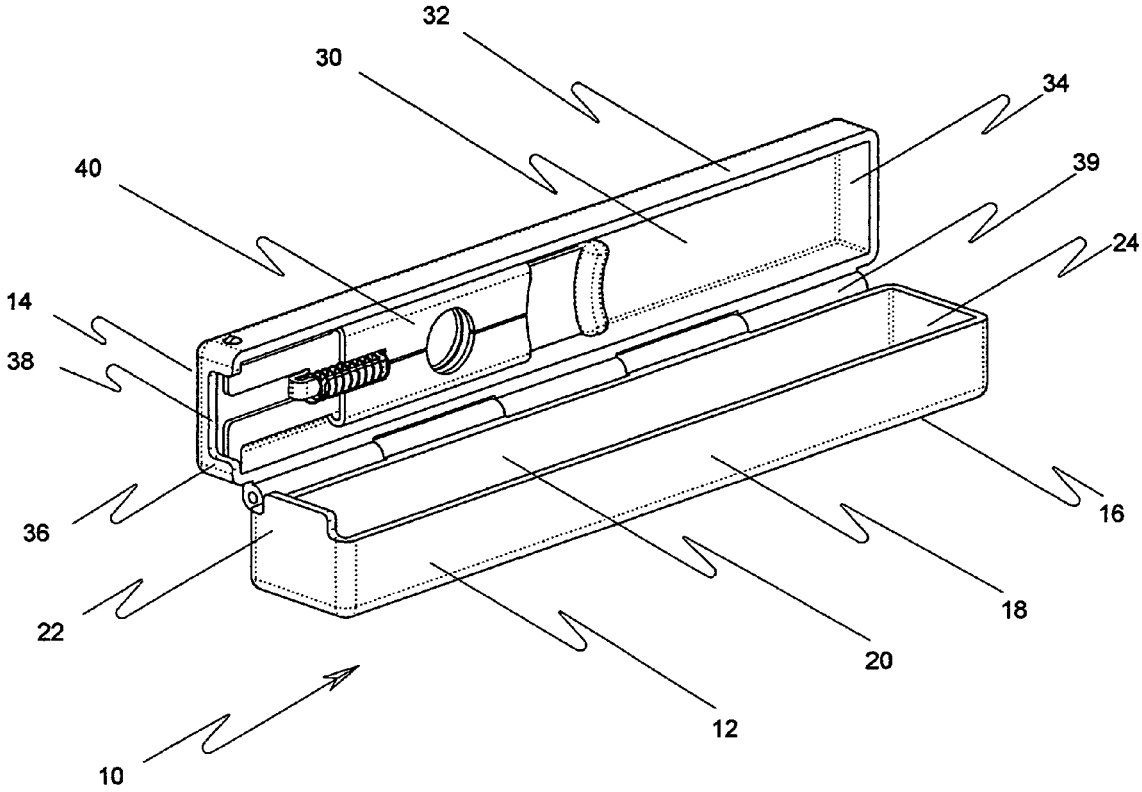
FIG. 1 represents a perspective view of a first embodiment of a cigarette or cigar preserver-container according to the present invention.
Figure 3:
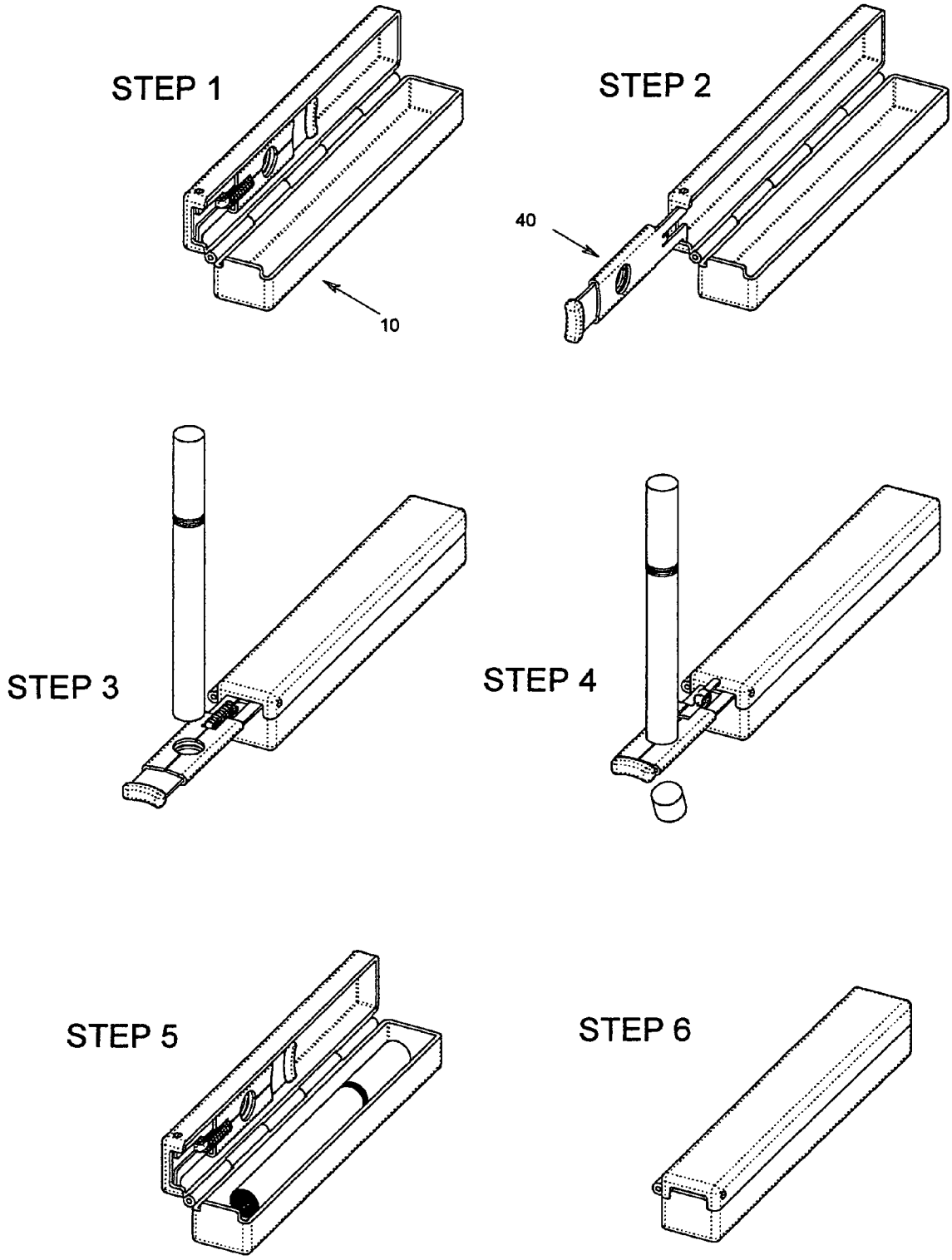
FIG. 3 shows how the embodiment of FIG. 1 may be used.

A first embodiment of a combined cigarette or cigar cutter and container is represented at 10 in FIGS. 1 and 3. Device 10 is shown illustratively as a box-like structure, but it will be understood that the invention may be embodied in other containers that use arcuate surfaces or which combine arcuate and planar surfaces. The first preferred embodiment, however, includes a lower portion 12 and an upper portion 14. The lower portion 12 provides a compartment for the storage of preferably one cigarette. Lower portion 12 includes a bottom surface 16, a front wall 18, a rear wall 20, and end walls 22, 24.

As illustrated, these walls are substantially perpendicular to the bottom surface 16. Preferably, they create an opening that is deep enough to house one cigarette. Preferably, the length of the lower portion 12 is just long enough for one cigarette. It will be understood that the box portion 12 may have planar walls as indicated, or it may have arcuate walls. The inside surface of the compartment may be lined with appropriate structure to provide a channel, groove, or other receptacle within the box for holding a single cigarette. Illustratively, the inside length of box portion 12 may be as much as 100 mm (for a cigarette). Its width may be on the order of 20-30 mm. If a device according to the present invention is to be used for cigars, the dimensions will of course be larger.

The upper portion 14 preferably comprises a generally rectangular top member 30, a front wall 32 downwardly dependent from top member 30, and a first end wall 34. Preferably, upper portion 14 in plan view is substantially the same size or very slightly larger than the opening of the lower portion 12, and when upper portion 14 closes upon lower portion 12, the front wall 32 becomes either co-planar with or parallel but spaced slightly from front wall 18. Likewise, end wall 34 will be either co-planar with or located outward from, parallel to, and facing end wall 24. A further end wall 36 for upper portion 14 may be provided with a recess 38 for access to a cutter 40 to be described below.

Upper portion 14 may be engaged by hinges 39 or the like that permit its articulation relative to the lower portion 12. Hinges 39 may be any standard type that permit relative rotation between the members joined. Alternatively, portion 14 may engage portion 12 in a different fashion such as by means of a pair of channels or other guide rails on either portion 14 or portion 12 with appropriate guides on the other portion 12 or 14, thus permitting portion 14 to slide longitudinally (or laterally) onto portion 12. Further still, portion 14 may snap onto the box portion 12 through appropriate snap fixtures which may involve pins and guides on appropriate parts of portions 12 and 14 or other suitable snap-fitting structures. Whichever specific engagement device is used, portion 14 will releasably engage portion 12 so that portion 14 may close upon portion 12 and contain a cigarette which will have been placed within portion 12, protecting it from exposure to the elements, from crushing, bending, and other undesired events.

A cutter 40 is associated with the upper portion 14, illustratively, although it will be understood that cutter 40 could be associated with the lower portion 12 instead. Cutter 40 is used for cutting off the burning or burned portion of the cigarette, leaving a fresh (or at least unburned) tobacco end which can be lit by the smoker.

Figure 2:
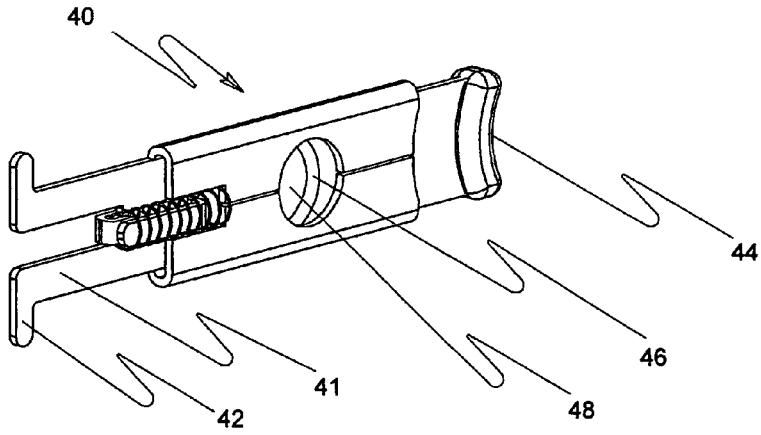
FIG. 2 shows a cutter for the embodiment of FIG. 1.

The cutter may be of the well-known cigar cutter form having a razor (or other sharp edge) with an angled surface movable through an aperture. The user puts the cigar or cigarette through the aperture and moves the cutting end of the razor through the opening to cut a portion off the cigarette. The cigarette may still be burning or may have been extinguished first. The construction of the cigar/cigarette cutter 40 is well-known and will not be described in detail herein, although FIG. 2 shows one representation of a cigar/cigarette cutter 40 that may be used with device 10.

Illustratively, the cutter 40 engages the inside surface of upper portion member 30 of portion 14. It may engage the underside of upper portion member 30 in a fashion permitting rotation therefrom or complete separation therefrom. That is to say, cutter 40 may be releasably engaged within a bay, channel, snap fitting or other engagement apparatus, or it may articulate from member 30. The embodiment of FIG. 1 has a rotational engagement. Thus, cutter 40 includes legs 41, each leg including a foot 42 extending therefrom. The tip of each foot 42 engages a respective receptacle 43 in which foot 42 may swivel, and along with it, the entire cutter 40. As shown, cutter 40 is thereby mounted within the compartment and can be rotated approximately 180 degrees for use. In such rotation, legs 41 rotate into recess 38 in the end wall 36. Cutter 40 also includes a finger-operated plunger 44 which, when operated, extends a cutting blade 46 through an aperture 48.

Referring to FIG. 3, a smoker who has consumed some but not all of a cigarette which he wishes to preserve for further smoking at a later time will open the device 10 by rotating the upper portion 14 away from lower portion 12 (Step 1), rotate the cutter 40 into position (Step 2), insert the cigarette through the aperture of cutter 40 (Step 3), and depress plunger 44 to snip off the burned part (Step 4). Typically the user will have extinguished the cigarette first, but this is not necessary.

After cutting the cigarette, the user restores the cutter 40 to its storage position and inserts the remaining unused cigarette portion into lower portion 12 or a compartment formed therein (Step 5). Finally, the user moves upper portion 14 into engagement with lower portion 12, either by rotation about the hinges 39 or by the other means previously described, thus closing the compartment (Step 6). The closed storage apparatus 10 may then be easily carried by the user, illustratively in a shirt or pant pocket, in a purse, or even attached to a carry apparatus on a belt, illustratively. At such future time as is convenient and desirable, the user can open container 10, remove the remaining portion of the cigarette, and relight it at that time.

Of course, one may carry a completely unused cigarette within container 10 rather than a partially-consumed one. It is not necessary that the cigarette (or cigar) transported within container 10 must first have been partially consumed.

Container 10 may also include space for one or more matches and may even provide a strike plate or surface, illustratively on one of the end walls 22 or 24, or front wall 18, for lighting a match.

The inside or outside surfaces (or both) of front wall 32 and other surfaces of device 10 provide a suitable location for a written message, an advertising message, a company logo, or other graphic and/or textual information. Accordingly, container 10 may be used as a promotional device.

Container 10 may be formed predominantly of metal and may have its surfaces painted, anodized, unfinished, chromed, plated, painted, embossed, or otherwise treated as desired for aesthetic or other purposes. Other materials, of course, may be used, including suitable plastics or other synthetics. As noted above, the particular shape of the device 10 is not required to be rectilinear, and the compartment may involve arcuate surfaces, on either portion 12 or 14, or both, or elsewhere. Also, device 10 may include external tabs to facilitate opening and closing the device. Preferably, device 10 is airtight when closed.

A Second Preferred Embodiment

Figure 4A:
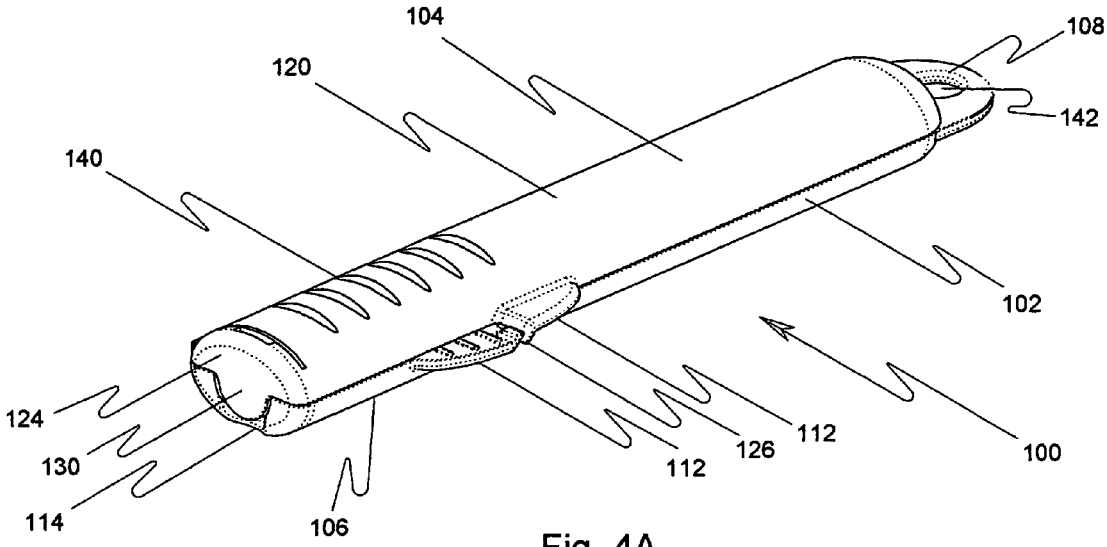
FIGS. 4A, 4B and 4C show a second embodiment of a cigarette or cigar preserver-container according to the present invention.
Figure 4B:
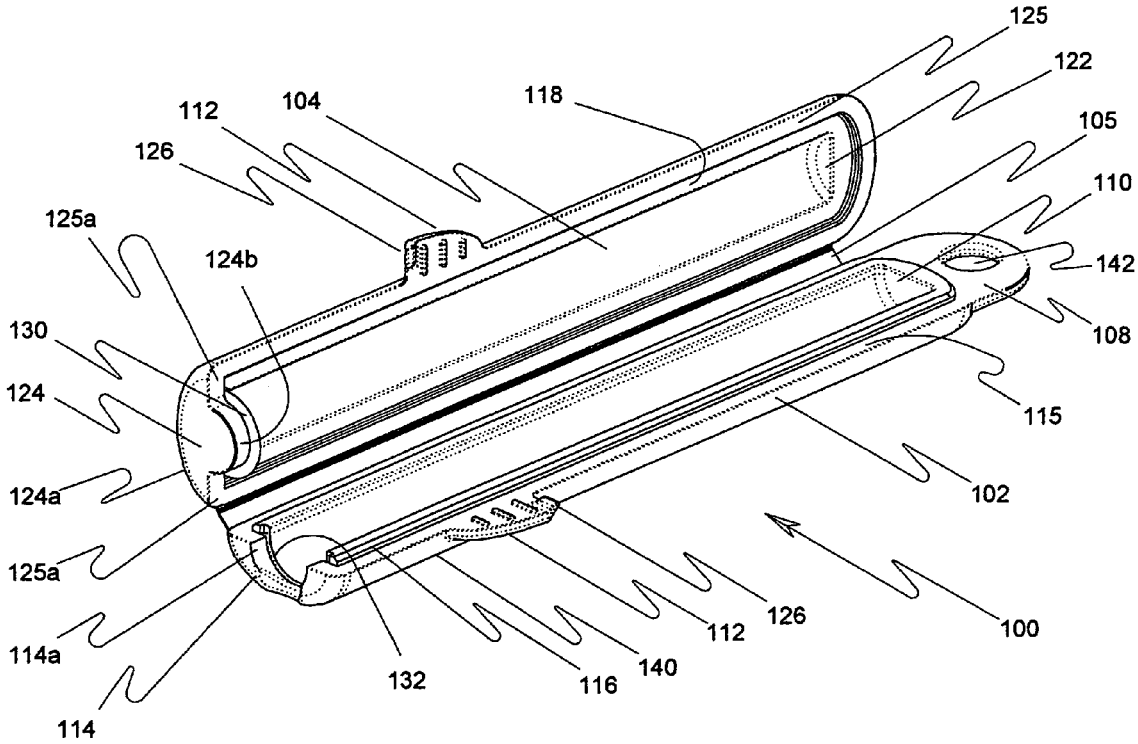
Figure 4C:
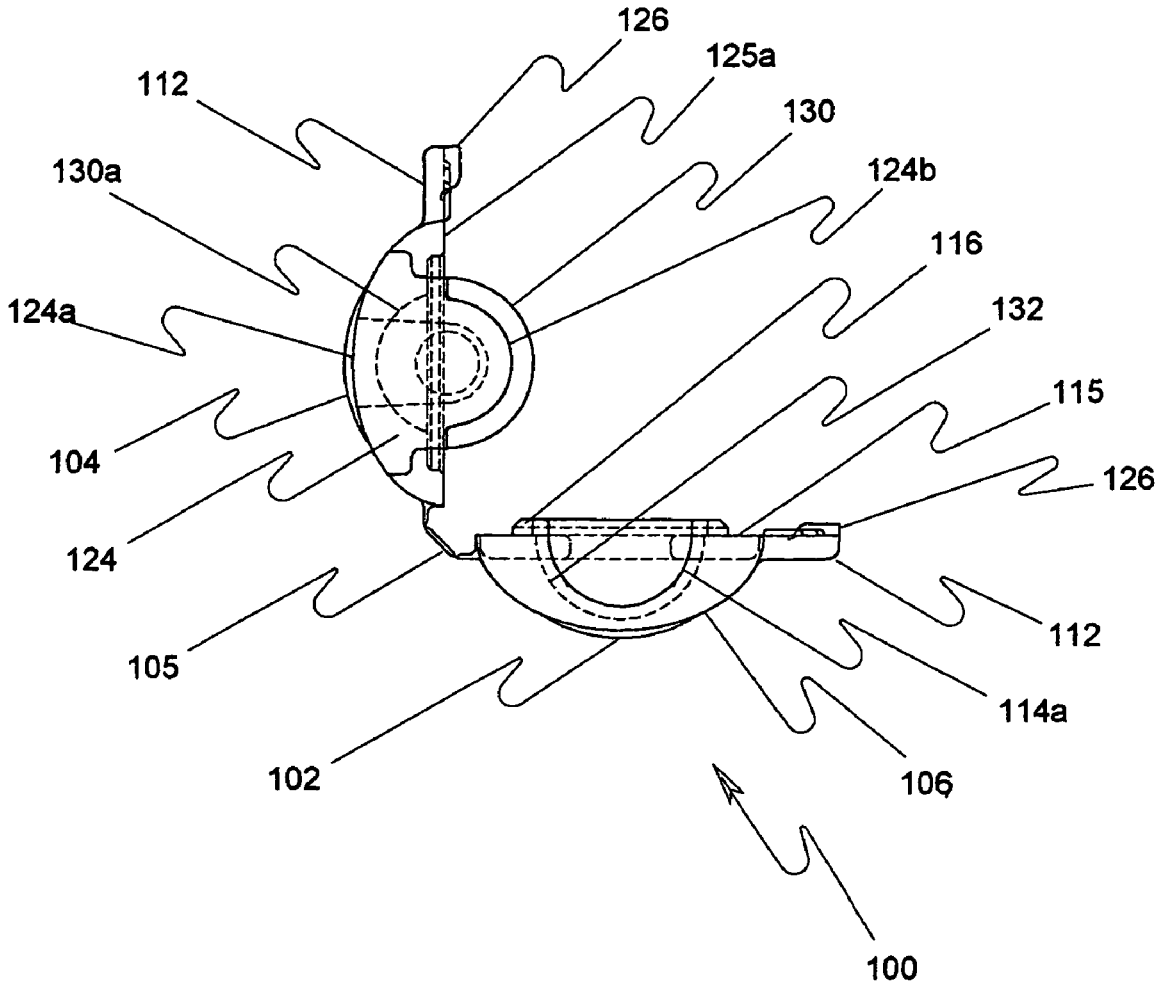

A device embodying aspects of the present invention may include curved surfaces. Device 100 is a second preferred embodiment according to various aspects of the present invention and is shown in FIGS. 4A, 4B, 4C and 5. Device 100 has a casing with curved major walls and arranges the cutting blade in a different manner than device 10. FIGS. 4A and 4B show perspective views of such second embodiment of a portable cigarette (or cigar) cutter and container 100 in the closed position and open position, respectively. FIG. 4C shows an end view.

Device 100 comprises a longitudinally-oriented lower section 102 and a longitudinally-oriented upper section 104, each forming a portion of a compartment for the cigarette. A hinge 105 joins sections 102 and 104 together. Hinge 105 may comprise a "living hinge" or may comprise any type of hinge or hinges which are well-known to fabricators. Preferably, the embodiment of hinge 105 in FIG. 4B extends substantially the full length of upper section 104.

Lower section 102 comprises a curved major wall 106 which extends most of the length of section 102, a generally flat, longitudinally extending end tab 108 at one end, a first end wall 110 depending downwardly from end tab 108, a laterally extending tab 112 used for opening the lower section 102 from the upper section 104, and a second end wall 114 at the end of curved wall 106 opposite to end tab 108 and end wall 110.

The open position shown in FIGS. 4B and 4C shows a flat shoulder or upper surface 115 located above curved wall 106. Preferably, shoulder 115 lies in the same plane as tabs 108 and 112. End wall 110 is preferably perpendicular to the plane of shoulder 115 and tab 108, but it could be at a different angle if desired. Rising upward from shoulder 115 is a neck 116. This raised neck 116 mates to an indentation 118 on upper section 104 (see FIG. 4B), assisting closure and creating a better seal to keep the cigarette fresh. Also, this seal of neck 116 to indentation 118 will snuff the cigarette if it were cut improperly.

The upper section 104 comprises a curved major wall 120, an end wall 122 at one remote end adjacent to end tab 108 of the lower section, and an opposing end wall 124 at the remote end of upper section 104. The length of the curved wall 120 preferably is equal to the length of the curved wall 106, which for a cigarette will preferably be on the order of 100 mm. A shoulder or surface 125 extends around the periphery of upper section 104, as shown in FIG. 4B. In plan view, shoulder 125 may be generally rectangular or may have curvature at one end or both ends. In the second embodiment, shoulder 125 is curved at the end near tab 108 and generally is not curved at the opposite end. Shoulder 125 is preferably flat and may include end regions 125*a* which are spaced apart from one another.

Hinge 105 permits the upper section 104 to rotate and close upon lower section 102. When closing, shoulder 125 moves into abutment with shoulder 115, and indentation 118 moves into abutment with neck 116. A snap member 126 extending outwardly from upper curved wall 120 and preferably in the same plane as shoulder 125 is positioned to engage tab 112 to snap the upper section shut and retain that position until the user manually separates the two for opening the device 100. Multiple snap members can be used.

Upper end wall 124 preferably includes an upper curved surface 124*a* extending from end regions 125*a* of the upper shoulder 125. Opposite curved surface 124*a*, end wall 124 includes a lower curved surface 124*b* between end regions 125*a* of the shoulder 125. A corresponding arcuate trough 114*a* matches the shape of curved surface 124*b* so that when the upper section 104 is closed upon the lower section 102, the two curved surfaces 124*b* and 114*a* close.

Just as the first embodiment includes a cutter having a razor or other blade 46 for cutting the partially consumed cigarette, the second embodiment device 100 preferably includes a blade 130 for this purpose. However, in this embodiment, blade 130 is preferably fixed in position in device 100 rather than being part of a separable or rotatable sub-assembly. The cutting blade 130 could be fixedly fastened at the extreme longitudinal or axial end of device 100 but preferably is fixedly fastened at a location spaced slightly inward from end wall 124 so that no part of the blade is exposed to the exterior when device 100 is closed. As seen in FIGS. 4B and 4C, blade 130 preferably has a generally elliptical or convex shape that is similar to lower curved surface 124*b* of end wall 124 but extends beyond surface 124*b* (permitting it to cut the cigarette). Preferably, blade 130 is affixed beside end wall 124 so that blade 130 is oriented transversely to the longitude of case 100. Illustratively, blade 130 can be fastened to the inside surface of end wall 124 by mechanical means or by an appropriate bonding agent or epoxy.

FIG. 4C is an end view of device 100 in the open position. Hinge 105 is shown on the left, and the snap member 126 and tab 112 of the lower section 102 are represented on the right. As seen in FIG. 4C, device 100 in its preferred configuration generally has opposed convex surfaces. One could provide a generally elliptical or oblong cross section (in the end view). The arcuate cutting surface of blade 130 is shown in FIGS. 4B and 4C. A receiving trough 132 is provided in lower section 102 to receive blade 130. Trough 132 generally conforms in shape to the exposed peripheral edge of the cutting blade 130. In FIG. 4C, an upper periphery 130*a* of blade 130 is shown in a broken line behind end wall 124.

To improve the safety of such a configuration, the cutting edge of blade 130 could be covered by a friction fit sleeve that extends around the arced exposed circumference of blade 130. Such sleeves are commonly used on disposable razors, for example, and could be made in a curved shape to conform to the shape of the exposed edge of blade 130. Before cutting the cigarette, the user removes the sleeve, and then restores it after cutting.

Figure 5:
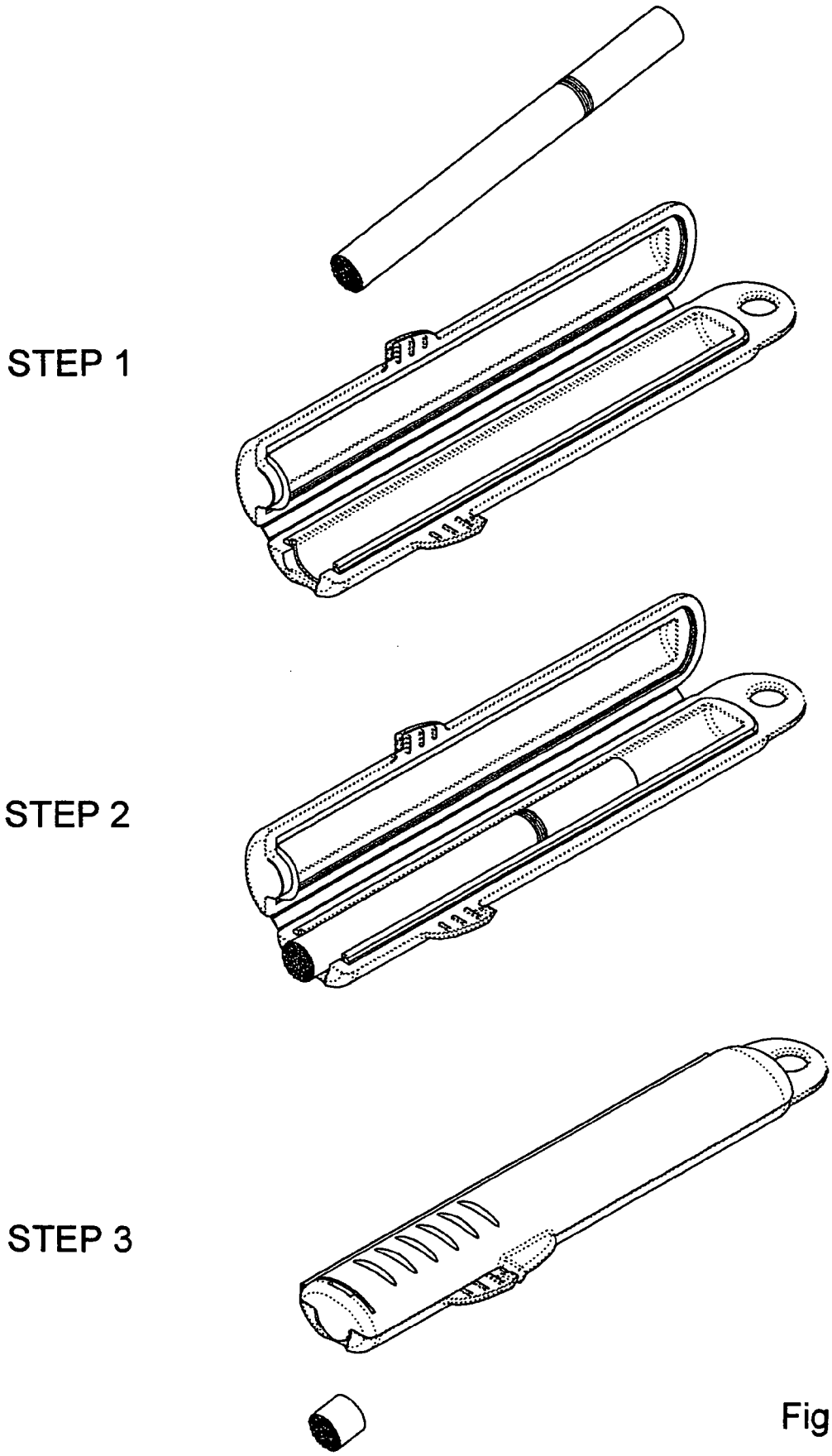
FIG. 5 shows how the embodiment of FIGS. 4A, B and C may be used.

FIG. 5 shows three steps for using device 100. The user opens the device 100 by rotating upper section 104 from lower section 102 (Step 1). He next places the cigarette within the lower section 102, a portion of it extending across arcuate trough 114*a* and beyond end wall 114 (Step 2). The user then closes the upper section 104 onto lower section 104, thereby causing blade 130 to slice through and separate the unused part of the cigarette from the used part (Step 3). The unused part of the cigarette is thereby enclosed on all sides within device 100 and is easily transported and made available for future use while being protected in the intervening time from external forces.

Upper section 104 may include a plurality of ridges 140 for ornamentation or for assisting the user in grasping the case 100. A group of ridges 140 is shown in FIGS. 4A and 5. It will be understood that this feature may be included in lower section 102 instead of or in addition to upper section 104. An alternative to ridges 140 is an indentation in the outside surface of curved wall 120, at the same location as ridges 140. Other structures may be included to facilitate gripping the device.

Tab 108 may be fitted with an aperture 142 to permit case 100 to be fastened to other objects such as a belt, key chain, other desired objects through appropriate fasteners.

Case 100 may be formed of the same materials as used for case 10. Advertising indicia or other markings may be included on appropriate surfaces of case 100, as for case 10.

Figure 6A:
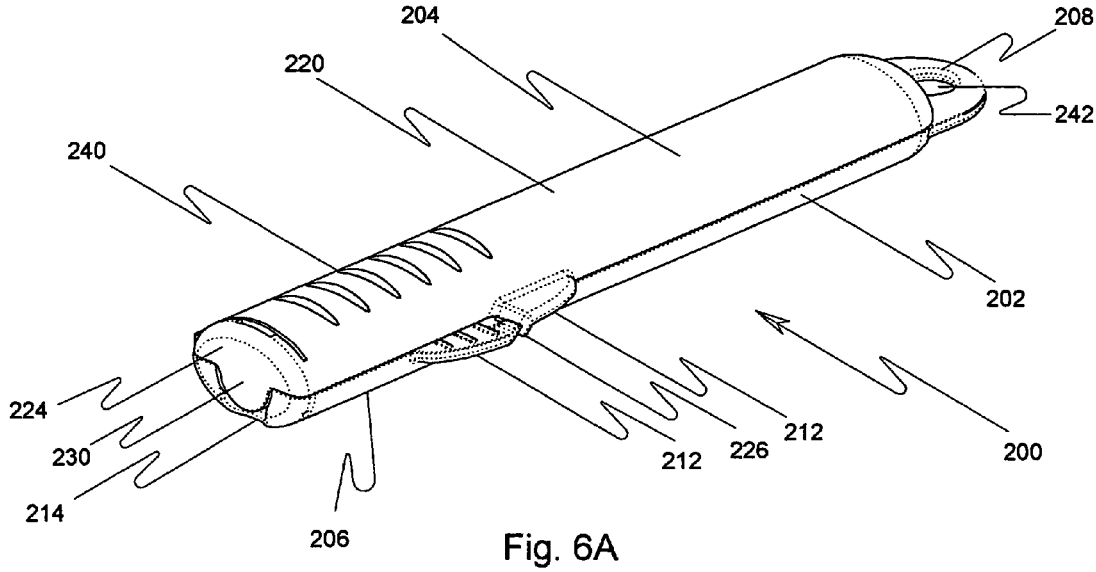
FIGS. 6A, 6B and 6C show a third embodiment of the present invention.
Figure 6B:
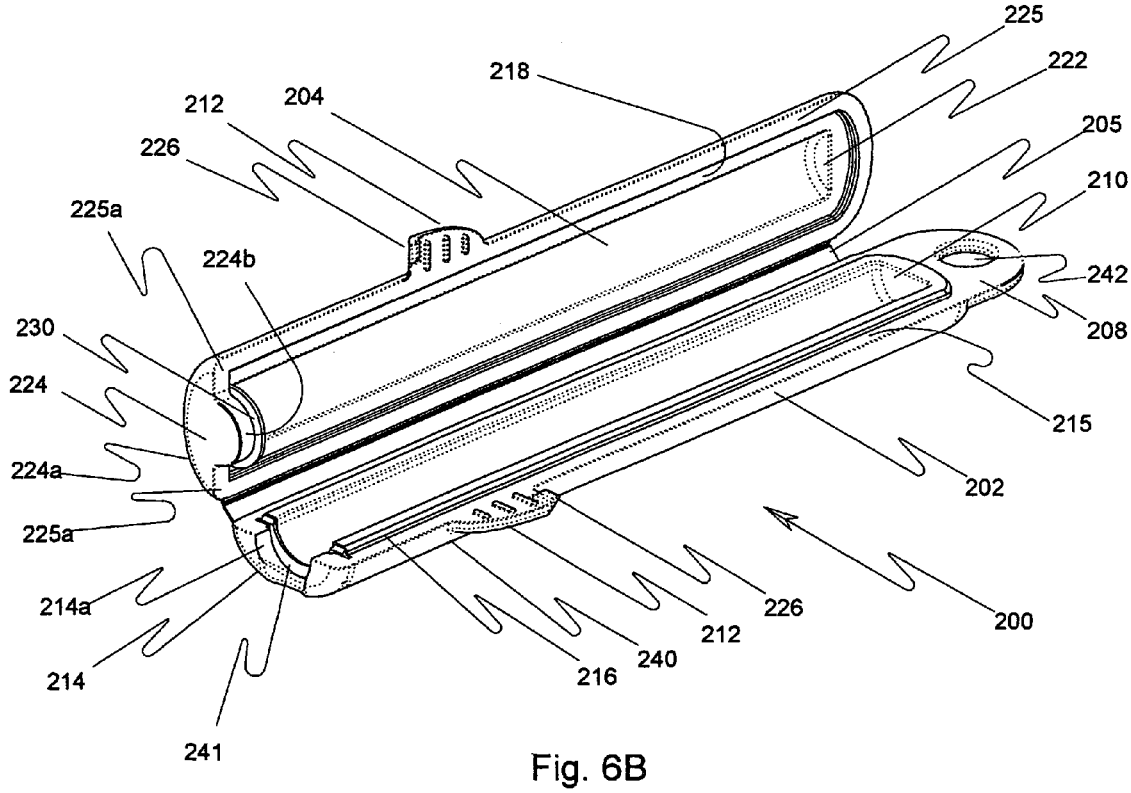
Figure 6C:
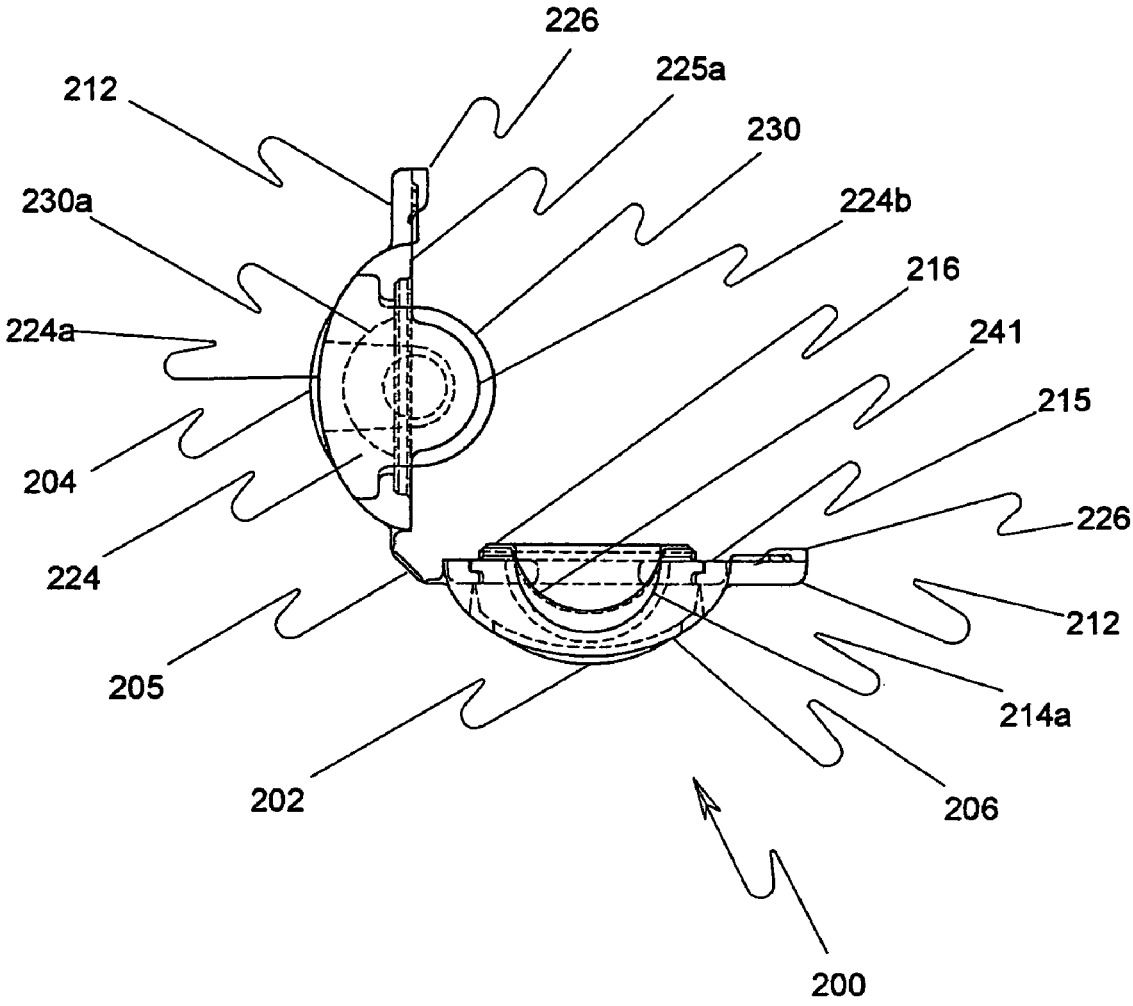
Figure 7:
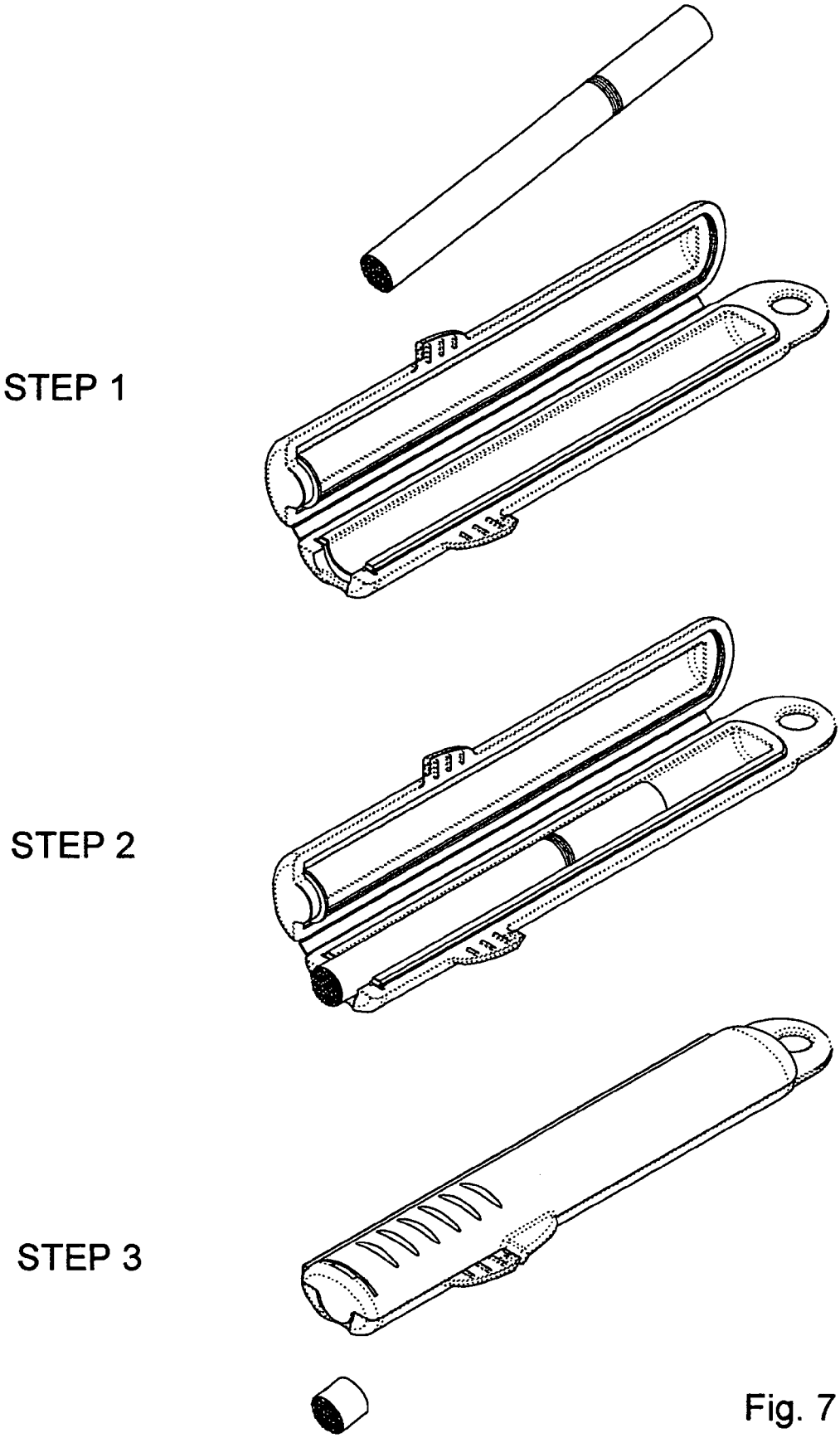
FIG. 7 shows how to use the third embodiment.

A third embodiment is provided. Device 200 embodies various aspects of the present invention and is shown in FIGS. 6A, 6B and 6C. Device 200 has substantially the same construction as device 100 but instead of including a razor or equivalent blade 130, device 200 provides a scissor-like structure having an upper cutting member 230 and a lower cutting member 241. These members 230 and 241 are both metallic and close against one another to slice the cigarette as a scissor slices paper or other materials. Thus, member 230 slides along member 241 to slice the cigarette.

Preferably each case 10, 100, and 200 is airtight so that imperfect separation of the ember from the cigarette will be tolerated. The short supply of air in the air tight compartment extinguishes the ember.

It will be appreciated that the disclosed devices can exclude the cutters and be used for cigarette/cigar snuffing and transportation.

It will be appreciated that what has been described herein is capable of further modifications and alternatives, and that the scope and spirit of the present invention can be used without employing the specific details enumerated herein or shown in the figures of the illustrative embodiments. The embodiments defined herein can be arranged in size for cutting and carrying a cigarette, or, in a larger version, one cigar. It is preferred that the scope of the present invention be defined by the appended claims.

The invention claimed is:

1. A combined cigarette or cigar cutter and container consisting essentially of:

an upper portion and a lower portion, each of said upper and lower portions being generally longitudinally oriented, said upper and lower portions cooperating to form a single, generally longitudinal closable and openable compartment having a size sufficient to contain a cigarette or cigar, a hinge engaging said lower and upper portions to permit rotation of one portion relative to the other portion, thereby to open or close said compartment, said hinge extending along substantially the entire length of said compartment; and a cutter located substantially at one end of said container and connected to said container;

wherein said upper portion or said lower portion includes a first end wall terminating along a curved outer periphery, wherein said first end wall is substantially perpendicular to the hinge, and wherein the curved outer periphery of the end wall extends beyond a first shoulder on said upper portion and beyond a second shoulder on said lower portion when the container is in the closed position, and wherein one of said upper or lower portions includes a curved outer surface that is substantially perpendicular to the first end wall.

2. The device according to claim 1 further consisting essentially of first and second tabs, said first tab extending from said lower portion, said second tab extending from said upper portion, said first and second tabs cooperating with each other to secure closure of said upper portion to said lower portion.

3. The device according to claim 1 wherein said device does not include a separate compartment for retaining consumed cigar or cigarette portions that become sliced off.

4. The device according to claim 1 wherein said cutter comprises a pair of scissor members, one scissor member being fastened to said upper portion and the other scissor member being fastened to said lower portion and being configured so that when the device is closed, said scissor members cooperate to cut a cigar or cigarette extending across said scissor members, whereby a user may position a cigar or cigarette across said scissor members and close said upper portion relative to said lower portion thereby to slice through said cigar or cigarette.

5. The device according to claim 1 further consisting essentially of a second end wall extending from said upper portion and third and fourth end walls extending from said lower portion, wherein said cutter cutting edge is adjacent and parallel to one of said end walls, and wherein said first end wall is larger than said second, third, and fourth end walls.

6. The device according to claim 5 wherein said first end wall is substantially flat in one dimension and includes a curved bottom and extends substantially perpendicularly to a longitudinal axis of said device, and wherein said cutter is located adjacent to said flat end wall.

7. The device according to claim 6 further including a trough located for receiving a portion of said cutter.

8. The device according to claim 1 wherein said device is substantially air tight.

9. The device of claim 1 wherein said hinge consists essentially of a living hinge.

10. The device of claim 1 further consisting essentially of a second end wall that does not extend beyond either of said shoulders in the closed position, so that one end wall is asymmetrical with the opposed end wall.

11. A combined cigarette or cigar cutter and container consisting essentially of:

an upper portion and a lower portion, each of said upper and lower portions being generally longitudinally oriented, said upper and lower portions cooperating to form a single, generally longitudinal closable and openable compartment having a size sufficient to contain a cigarette or cigar, a hinge engaging said lower and upper portions to permit rotation of one portion relative to the other portion, thereby to open or close said compartment, said hinge extending along substantially the entire length of said compartment; and a cutter located substantially at one end of said container and connected to said container;

a first end wall, a first flat shoulder on said upper portion, a second flat shoulder on said lower portion, a U-shaped raised neck adjacent one of said shoulders, the U-shaped raised neck flanking the single compartment for the cigar or cigarette, and a corresponding indentation for receiving said neck adjacent the other one of said shoulders, the shoulders, raised neck and indentation being dimensioned so that when the compartment is closed, the shoulders come into contact with one another and the raised neck fits into the indentation.

12. A combined cigarette or cigar cutter and container comprising:

an upper portion extending generally longitudinally, said upper portion including a curved surface and a first end wall extending from said curved surface;

a lower portion having a curved surface extending generally longitudinally, said lower portion including a second end wall extending from said lower portion curved surface;

a hinge between said upper and lower portions;

said upper and lower portions forming only a single compartment when closed, said compartment being sized to contain substantially one cigar or cigarette;

the hinge extending along substantially the entire length of the compartment;

portions of said upper and lower portions being configured to meet one another in a first imaginary plane that generally bisects the container horizontally, said first end wall being substantially flat and including a curved portion along its bottom surface, wherein said first end wall extends beyond said imaginary plane when the container is in the closed position, and a cutter affixed adjacent and generally parallel to said first end wall or said second end wall and arranged with cutting elements substantially perpendicular to an axis of rotation of the hinge.

13. The device according to claim 12 wherein said cutter comprises a scissor having first and second cutting elements affixed adjacent to said first and second end walls respectively.

14. The device according to claim 12 wherein said compartment is air tight when said upper portion and lower portion are in a closed position.

15. The device according to claim 12 further comprising a receiving trough located opposite said cutter, positioned so that when said upper portion is being closed relative to said lower portion, an exposed portion of said cutter is positioned to cut through said cigar or cigarette and then extend into said receiving trough.

16. The device according to claim 12 wherein said hinge includes a plurality of sleeves arranged coaxially and consecutively adjacent to each other, without substantial gaps between consecutive ones of the sleeves, and so that the coaxial sleeves collectively extend substantially the entire length of said compartment.

17. The device of claim 12 wherein said hinge comprises a living hinge.

18. A combined cigarette or cigar cutter and container movable between an open position and a closed position and comprising:

a first portion having a curved outside surface and extending generally longitudinally a first length, The first portion including a first end wall extending from the first portion curved surface, the first end wall including a curved bottom outside surface, the first portion defining a first portion of a compartment;

the first portion including a first flat shoulder extending beside at least two sides of the first compartment portion;

a second portion extending generally longitudinally a second length, the second portion including a second end wall, the second portion defining a second portion of the compartment, the second portion including a second flat shoulder extending beside at least two sides of The second compartment portion;

a raised neck adjacent to one of the flat shoulders and located on the first portion or the second portion;

on the other one of said first portion and said second portion, an indentation sized and positioned to receive said raised neck when the container is in a closed position, a hinge extending alone substantially the entire first length or the entire second length and operatively connected between the first and second portions so that the first and second portions are rotatable between open and closed positions;

the first compartment portion and the second compartment portion, when said container is in said closed position, defining only a single compartment sized to contain substantially one cigar and cigarette;

the shoulders, raised neck and indentation being dimensioned so that in the closed position, the flat shoulders come into contact with one another and the raised neck fits into the indentation;

a cigarette-cigar cutter affixed adjacent to the first end wall or the second end wall, said cutter comprising a scissor mechanism having first and second cutting elements affixed adjacent to the first and second end walls respectively;

a receiving trough located opposite said cutter, so that when said first and second portions are being closed, an exposed portion of said cutter is positioned to cut though said cigar or cigarette and then extend into said receiving trough, and wherein said indentation is substantially U-shaped.

19. A combined cigarette or cigar cutter and container movable between an open position and a closed position and comprising:

a first portion having a curved outside surface and extending generally longitudinally a first length, the first portion including a first end wall extending from the first portion curved surface, the first portion defining a first portion of a compartment;

the first portion including a first flat shoulder extending beside at least two sides of the first compartment portion;

a second portion extending generally longitudinally a second length, the second portion including a second end wall, the second portion defining a second portion of the compartment, the second portion including a second flat shoulder extending beside at least two sides of the second compartment portion;

a raised neck adjacent to one of the flat shoulders and located on the first portion or the second portion;

on The other one of said first portion and said second portion, an indentation sized and positioned to receive said raised neck when the container is in a closed position, a hinge extending along substantially the entire first length or the entire second length and operatively connected between the first and second portions so that The first and second portions are rotatable between open and closed positions;

the first compartment portion and the second compartment portion, when said container is in said closed position, defining only a single compartment sized to contain substantially one cigar or cigarette;

the shoulders, raised neck and indentation being dimensioned so that in the closed position, the flat shoulders come into contact with one another and the raised neck fits into the indentation; and a cigarette-cigar cutter affixed adjacent to the first end wall or the second end wall, said cutter comprising a scissor mechanism having first and second cuffing elements affixed adjacent to the first and second end walls respectively, wherein the first and second shoulders extend around three sides of the compartment; the raised neck extends around the same three sides of the compartment; and the indentation extends around the same three sides of the compartment.

* * * * *